United States Patent [19]

Zemke, Jr.

[11] Patent Number: 5,056,159

[45] Date of Patent: Oct. 15, 1991

[54] COMBINATION TRAY AND BIB

[76] Inventor: William L. Zemke, Jr. 299 S. Shore Dr., Forest Lake, Minn. 55025

[21] Appl. No.: 586,510

[22] Filed: Sep. 21, 1990

[51] Int. Cl.[5] ..... A41B 13/10; A41D 1/00

[52] U.S. Cl. ..... 2/49 A; 2/46

[58] Field of Search ..... 2/46, 48, 49 R, 49 A, 2/50, 51; 206/45.28; 224/202; 229/904; 383/7, 10, 22, 66

[56] References Cited

U.S. PATENT DOCUMENTS

| | | | |
|---|---|---|---|
| 414,450 | 11/1889 | Schwartz | 206/45.28 |
| 2,002,618 | 5/1935 | Sutter | 206/45.28 |
| 2,265,690 | 12/1941 | Fiedler | 2/48 |
| 2,782,420 | 2/1957 | Barager | 2/49 R |
| 2,803,390 | 8/1957 | MacKay | 229/904 X |
| 3,851,760 | 12/1974 | Smith . | |
| 3,945,048 | 3/1976 | Shearer . | |
| 3,995,321 | 12/1976 | Johnson . | |
| 4,114,199 | 9/1978 | Malan . | |
| 4,215,432 | 8/1980 | Smith | 2/48 |
| 4,646,364 | 3/1987 | O'Larey . | |
| 4,838,429 | 6/1989 | Fabisiewicz et al. | 383/66 X |
| 4,938,608 | 7/1990 | Espinosa | 383/7 |

OTHER PUBLICATIONS

2-Page brochure by Stiegler re. Universal Sealing Machines.

8-Page brochure by Azzurra Trading S.r.L. re. SAC-O-Matic.

*Primary Examiner*—Werner H. Schroeder
*Assistant Examiner*—Jeanette E. Chapman
*Attorney, Agent, or Firm*—Merchant, Gould, Smith, Edell, Welter, Schmidt

[57] ABSTRACT

A tray-bib (10) has a tray portion (12) covering a wearer's lap and a bib portion (14) covering a wearer's chest and stomach. The tray (12) forms a cavity with a bottom (18), sides (20), and ends (22). The bib portion (14) tears along perforations (24) and folds up from a top portion (16) of the tray (12) to direct spillage into the tray (12). The bib portion (14) also has a collar portion (30) which fits around the neck of the wearer to support the bib (14). The sides (20) and ends (22) retain the spilled debris in the tray (12) so that it does not spill onto the seat or wearer's lap.

23 Claims, 1 Drawing Sheet

COMBINATION TRAY AND BIB

BACKGROUND OF THE INVENTION

1. Field of the Invention

The present invention relates to disposable protective bibs, and more particularly, to one piece disposable protective bib-trays having lap area protectors as an integral part thereof which are adapted to catch and retain falling or spilled hot or cold food and drinks.

2. Description of the Prior Art

The prior art, as represented by U.S. Pat. No. 4,114,199, teaches a disposable bib tray produced from a single flat piece of stiff sheet material such as paper, and assembled by cutting and folding. However, this bib tray design requires material of a certain stiffness, and films made from commonly used materials such as polyethylene and polyvinylchloride are unsuitable. As a result, this bib tray lacks the ability to be manufactured using polyethylene or other liquid impermeable material, and also to be easily packaged in roll form. In addition, assembly of this design of bib tray is complicated, requiring cutting and folding, making it inconvenient to use while travelling. This design lacks the versatility and convenience of the bib of the present invention.

The prior art also discloses disposable protective bibs having a pocket member for catching falling and spilled food. Typical bibs of this type are disclosed in U.S. Pat. Nos. 3,995,321, and 3,945,048. The use of pockets, however, does not adequately protect the lap area from spilled food and drink, particularly when eating or drinking while travelling. The pockets do not protect the lap area while eating or drinking in a variety of positions from sitting to semi-prone.

Accordingly, it is the object of the present invention to provide an inexpensive, single piece, disposable bib-tray with a lap area protector. It is another object of this invention to provide a bib and lap area protector made out of a liquid impermeable material which can be conveniently packaged on a roll. It is still a further object of this invention to provide an easily assembled, flexible bib and lap area protector which retains spilled foods and liquids from and which is made from a single piece of material by tearing perforations to form the body of the bib portion, the head and neck opening, and the cavity of the lap area portion.

It is evident that a disposable bib-tray which is liquid impermeable, easy to assemble, convenient to package and store, and which also protects the lap area would be advantageous to anyone who eats or drinks while travelling by car or plane, while in a hospital bed or health care center, and which may be used during dental work. The present invention solves these and other problems associated with disposable bibs.

SUMMARY OF THE INVENTION

The present invention is directed to a tray-bib used to protect a wearer from spilled food and liquids. The tray-bib includes a tray portion having a bottom, sides, sealed end portions and a top portion which is placed on the lap of a wearer. The top portion has a perforated outline of a bib therein so that the bib portion lifts out of the top sheet but remains attached at the lower end to cover the chest and stomach of the wearer, so that when worn, any spills are directed into the tray through the opening in the top sheet remaining upon lifting the bib.

The bib portion includes a collar portion with a center portion which folds back to create an opening for the head and neck. The collar portion is placed around the neck of the wearer to support the bib. Any spillage is directed down the bib and into the attached tray where it is retained in the cavity formed by the tray for disposal.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference numerals indicate corresponding elements throughout the several views.

DETAILED DESCRIPTION OF THE PREFERRED EMBODIMENT(S)

Figure 1:
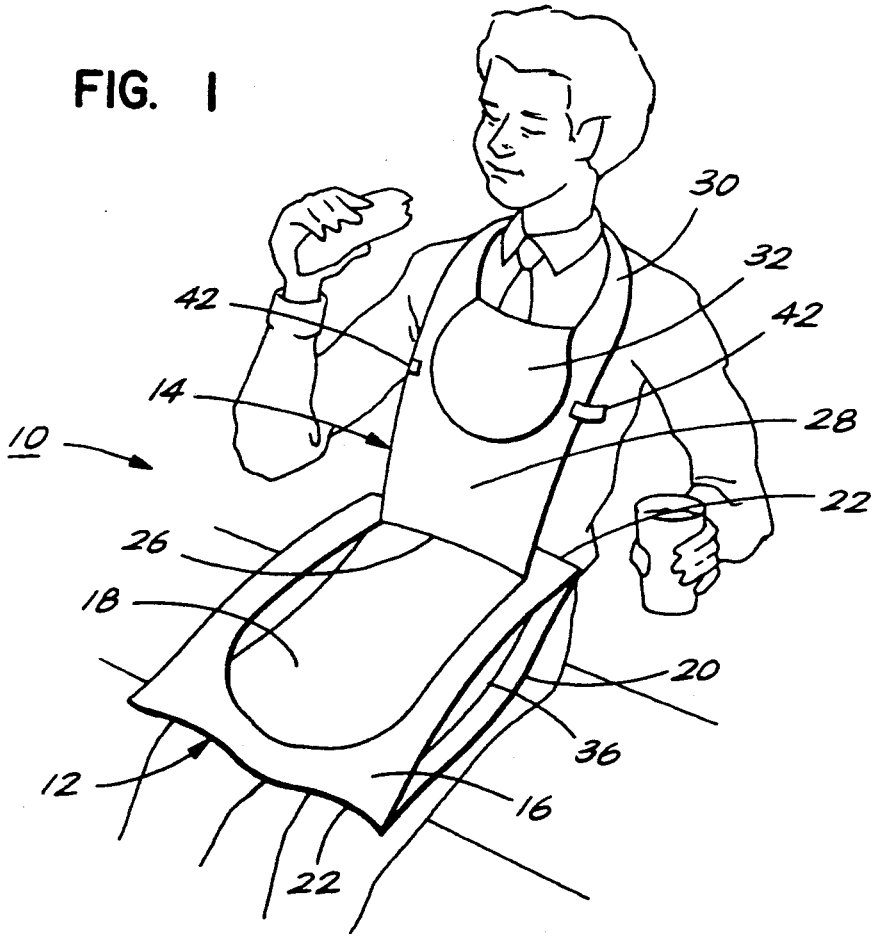
FIG. 1 shows a perspective view of a tray-bib placed on a wearer according to the principles of the present invention.

Referring now to the drawings, and referring in particular to FIG. 1, a tray-bib 10 is shown. A tray portion 12 protects the lap of a wearer and an attached bib portion 14 covers the chest and stomach of the wearer and directs spills into the tray portion 12. The tray portion 12 has a sealed bag type construction having opposing sheets sealed together at the ends and sides. When placed on the lap of a wearer, the tray 12 has a top sheet 16 and a bottom sheet 18 with sides 20 and sealed ends 22 connecting the top 16 and the bottom 18. Pleats 36 on the sides 20 provide height to the tray 12 so that spillage directed into the tray 12 does not slide off the tray and onto the floor, the seat, or the lap of the wearer as occurs with ordinary napkins. In the preferred embodiment, the tray-bib 10 is made of flexible liquid impermeable material, typically a flexible plastic such as polystyrene, polyethylene, polypropylene, or biodegradable plastic which preferably has a thickness on the order of less than 1 millimeter. With this construction, it can be appreciated that the tray bib 10 may be transparent or have a variety of colors, or logos and designs printed thereon for promotions and advertising.

Figure 3:
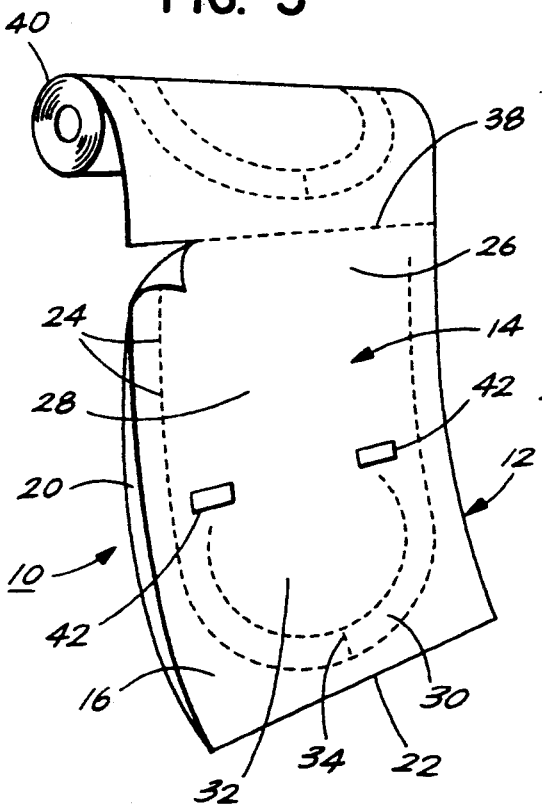
Figure 2:
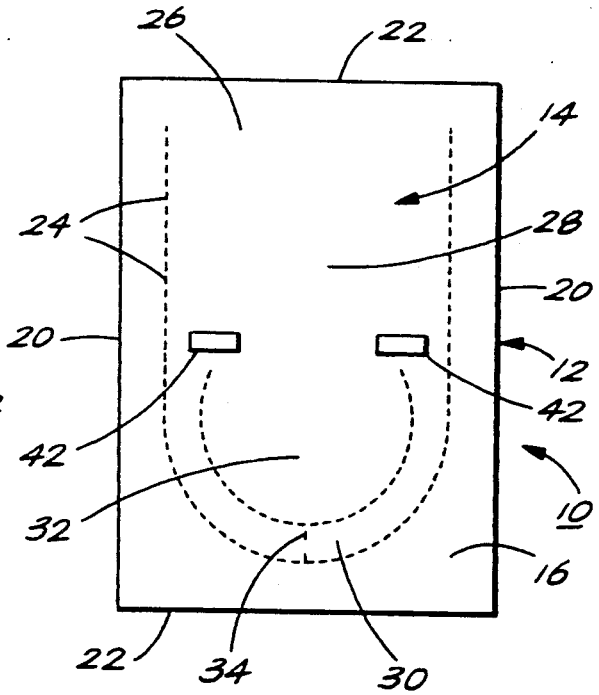
FIG. 2 shows a top plan view of the tray-bib of FIG. 1 with the bib portion still fully attached in the top portion; and, FIG. 3 is a perspective view of the tray-bibs shown in FIG. 1 connected on a roll for dispensing.

As shown in FIGS. 2 and 3, the top sheet 16 has perforations 24 formed therein in the outline of a portion of the bib 14 such that upon tearing the top sheet 16 along the perforations, the bib portion 14 lifts up from the top sheet 16. A base 26 of the bib portion 14 is unperforated so that the bib remains attached to the top sheet 16 of the tray 12. With this arrangement, the bib 14 remains attached along the base 26 such that spilled food is always directed down the bib 14 into the opening in the top portion 16 shown in FIG. 1 which remains when the bib is lifted for use.

As shown in FIG. 1, the bottom 18, sides 20, ends 22 and the remaining top portion 16 form a receptacle adapted for collecting and retaining any spilled food and liquids. In addition, the pleats 36 act as pockets around the edges of the tray 12 so that upon removal of the tray-bib 10 from the wearer, the spilled food and liquid does not run off the tray portion 12. The inexpensive flexible construction and use of a biodegradable or recyclable material provides for disposal and recycling after a single use or provides for emptying and cleaning if necessary, and reuse.

The bib 14 lifts up from the top 16 and covers the chest and stomach of the wearer with a protective sheet portion 28. The upper portion of the bib 14 forms a collar portion 30 which fits around the neck of the wearer, by folding down or removing a perforated center portion 32 shown in FIG. 2. The collar 30 has a narrower tearable portion 34 which tears easily to prevent choking and which may include a perforated slit perpendicular to the perforations defining the collar 30. The bib 14 may also be supported by tucking the center portion 32 or the entire collar portion 30 into the wearer's shirt collar rather than wearing the collar portion 30 around the neck.

The bib portion 14 may also be supported by pieces of adhesive 42, such as pressure sensitive adhesive, which may be attached to the bib 14 as shown in FIGS. 2 and 3, and then removed and secured to the bib 14 and wearer's shirt, as shown in FIG. 1. The adhesive 42 may be used in place of the collar portion 30, or in addition to the collar, as shown in FIG. 1.

In one embodiment, the tray-bib 10 is connected to other tray-bibs on a roll 40 for dispensing, as shown in FIG. 3. When dispensed on the roll 40, the tray-bibs 10 are connected at the ends 22 to one another with a perforated connection 38 so that the individual tray-bibs 10 tear off the roll 40. The tray-bibs 10 may also be individually packaged for distribution with meals, such as on airplanes, in fast food restaurants, health care centers, or at dental offices.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A disposable bib-tray comprising a bib portion and a lap area portion; wherein two liquid impermeable sheets are layered on top of one another and sealed together at edges of the sheets to form an internal cavity, wherein a top sheet of the material has perforations defining the bib portion including an unperforated base, such that when the bib portion is pulled away from the top sheet, the base of the bib portion remains attached to the top sheet; wherein the lap area portion is comprised of a bottom sheet of the liquid impermeable material sealed at the edges to the top sheet having an opening defined by the perforations of the bib portion and the base of the bib.

2. The disposable bib-tray of claim 1 wherein the liquid impermeable sheets are comprised of flexible plastic.

3. The disposable bib-tray of claim 1 wherein the liquid impermeable sheets are comprised of a flexible material selected from the group consisting of polystyrene, polyethylene, polypropylene, or biodegradable plastic.

4. The disposable bib-tray of claim 1 wherein the liquid impermeable sheets have a thickness of 1.0 mil. or less.

5. The disposable bib-tray of claim 1 wherein at least two opposing edges are pleated.

6. The bib-tray of claim 1 further comprising bib supporting means.

7. The bib-tray of claim 6 wherein the bib supporting means comprises adhesive adapted for attaching to the bib and the shirt of a wearer.

8. The disposable bib-tray of claim 1 wherein the bib portion further comprises a neck-fastening means having a perforated semi-circular neck outline defining a collar portion which is distal to the base of the bib portion.

9. The disposable bib-tray of claim 8 wherein the neck-fastening means has a perforated slit centrally located on the collar portion and substantially perpendicular to the perforations defining the collar portion.

10. A tray-bib having a substantially flat configuration with a top sheet portion, a bottom sheet portion, and side portions, wherein the top sheet portion is sealed to the side portions and the bottom sheet portion and wherein the bottom sheet portion is sealed to the side portions, wherein the top portion is perforated along a portion of an outline of a bib, the bib having an unperforated base, so that upon tearing the top portion along the perforations, and placing the tray bib on the lap of a wearer, the bottom portion forms a tray and the bib portion lifts up from the base of the bib to cover the front of a wearer such that spilled food is directed into the tray.

11. A tray-bib according to claim 10, wherein the side portions are pleated.

12. A tray bib according to claim 10, wherein the bib portion includes a collar portion encircling the neck of the wearer.

13. A tray-bib according to claim 12, wherein the collar portion includes a perforated tear section.

14. A tray-bib according to claim 10, wherein the bib portion is configured for tucking into the wearer's collar.

15. A tray-bib comprising a tray portion covering a wearer's lap and an attached bib portion covering a wearer's chest and stomach, wherein the tray portion has a bottom portion, closed end and side portions, and a top portion, wherein the top portion is perforated along a portion of an outline of a bib so that the top portion tears along the outline of a bib such that the bib portion folds up from the top portion at an attached lower end.

16. A tray-bib according to claim 15, wherein the tray-bib is comprised of a flexible plastic material.

17. A tray-bib according to claim 15, wherein the tray portion comprises a flexible bag sealed at both ends and perforated along the bib outline.

18. A tray-bib according to claim 15, wherein the bib portion further comprises a collar portion encircling the neck.

19. A tray-bib according to claim 18, wherein the collar portion further comprises a perforated tear section to prevent choking.

20. A roll of disposable bib-trays wherein each bib-tray comprises a bib portion and a lap area portion; wherein two liquid impermeable sheets are layered on top of one another and sealed together at edges of the sheets to form an internal cavity, wherein a top sheet of the material has perforations defining the bib portion including an unperforated base, such that when the bib portion is pulled away from the top sheet, the base of the bib portion remains attached to the top sheet; wherein the lap area portion is comprised of a bottom sheet of the liquid impermeable material sealed at the edges to the top sheet having an opening defined by the perforations of the bib portion and the base of the bib, wherein the bags are attached at the ends to adjacent bags.

21. A tray-bib adapted for covering a wearer's lap, chest and stomach, comprising a tray portion covering the wearer's lap and an attached bib portion covering the front portion of the wearer's stomach and chest, wherein the tray portion has a bottom portion, closed end and side portions, and a top portion, wherein the bib portion has a collar portion and a base, and wherein the bib portion connects to the tray top portion along the bib base whereby the tray top portion tears along a perforated outline of the collar portion and the bib portion so that the bib portion lifts up from the tray top portion and remains attached at the base to direct debris into the tray portion.

22. A tray-bib according to claim 21, wherein the tray-bib comprises a bag sealed on both ends.

23. A tray-bib according to claim 22, wherein the tray-bib attaches to additional tray-bibs on a roll at the ends of the tray portion along a perforated connection.

* * * * *